US005291691A

United States Patent [19]

Unno et al.

[11] Patent Number: 5,291,691

[45] Date of Patent: Mar. 8, 1994

[54] METHOD AND APPARATUS FOR DRESSING AN ELECTROPLATED GRINDING WHEEL

[75] Inventors: Kunihiko Unno, Kariya; Masato Kitajima, Hekinan; Hajime Fukami, Nagoya; Akimitsu Kamiya, Okazaki; Shinji Soma, Handa, all of Japan

[73] Assignee: Toyoda Koki Kabushiki Kaisha, Kariya, Japan

[21] Appl. No.: 828,105

[22] Filed: Jan. 30, 1992

[30] Foreign Application Priority Data

Feb. 5, 1991 [JP] Japan ..... 3-14412

[51] Int. Cl.[5] ..... B24B 49/00

[52] U.S. Cl. ..... 51/165.87; 51/325

[58] Field of Search ..... 51/165.87, 165.71, 5 D, 51/325; 125/11.01, 11.03

[56] References Cited

U.S. PATENT DOCUMENTS

| | | | |
|---|---|---|---|
| 3,602,210 | 8/1971 | Appleton | 125/11.03 |
| 4,475,321 | 10/1984 | Meyer | 125/11.03 |
| 4,492,061 | 1/1985 | Smith | 51/165.87 |
| 4,557,078 | 12/1985 | Brill | 51/165.87 |
| 4,640,057 | 2/1987 | Salje | 51/165.87 |
| 4,897,967 | 1/1990 | Maruyama et al. | 125/11.03 |

FOREIGN PATENT DOCUMENTS

| | | |
|---|---|---|
| 52-50088 | 4/1977 | Japan . |
| 53-101793 | 9/1978 | Japan . |
| 62-203758 | 9/1987 | Japan . |
| 64-71620 | 3/1989 | Japan . |

*Primary Examiner*—M. Rachuba

*Attorney, Agent, or Firm*—Oblon, Spivak, McClelland, Maier & Neustadt

[57] ABSTRACT

A dressing apparatus for dressing an electroplated grinding wheel by crushing the top portions of the abrasive grains thereof. The abrasive grains are diamond grains or CBN grains. A role made of ceramics, or a ferrous role holding diamond grains on its outer periphery is used for crushing the abrasive grains. The grinding wheel is rotated in one direction and the role is rotated in the opposite direction so that the difference in surface speed between the role and the grinding wheel becomes substantially zero. The role is then advanced toward the grinding wheel to crush the top portions of the abrasive grains, so that the heights of the abrasive grains are roughly equalized, and many sharp cutting edges are formed at the top portions of the abrasive grains.

5 Claims, 6 Drawing Sheets

METHOD AND APPARATUS FOR DRESSING AN ELECTROPLATED GRINDING WHEEL

BACKGROUND OF THE INVENTION

1. Field of the Invention

This invention relates to a method and an apparatus for dressing an electroplated grinding wheel in which abrasive grains are held on the peripheral surface of a circular core.

2. Prior Art of the Invention

FIG. 1 shows a well known electroplated grinding wheel. Diamond grains or CBN (Cubic Boron Nitride) grains 14 are held on the peripheral surface of a circular core 12 by a nickel plating layer 13. When the change in height among the abrasive grains 14 is large, the surface roughness of the grinding wheel becomes worse, deteriorating the surface roughness of the finished surface of a workpiece ground by the grinding wheel.

To improve the surface roughness of the finished surface of a workpiece, a method has been proposed in which an electroplated grinding wheel is trued with a diamond truing wheel. By this truing, the top portions of some abrasive grains whose heights are relatively high are removed so that flat surfaces 14*a* are formed at their tops, as shown in FIG. 2. This method, however, has a problem that the grinding resistance during grinding operations is very high just after the truing, because the tops of some abrasive grains are flat. The high grinding resistance causes a rapid wear of the abrasive grains and other problems.

In another method, abrasive grains having the same diameter are used so as to reduce the change in height among the abrasive grains. This method, however, has a problem that a large amount of time and labor cost are required for selecting abrasive grains having the same diameter, thereby resulting in an increase of the production cost.

SUMMARY OF THE INVENTION

Accordingly, it is an object of the present invention to provide an improved method and an improved apparatus for dressing an electroplated grinding wheel capable of increasing the grinding accuracy while decreasing the grinding resistance.

It is another object of the present invention is to provide an improved method and an improved apparatus for dressing an electroplated grinding wheel in which the abrasive grains of the grinding wheel are crushed to roughly have the same height.

Briefly, in the present invention, a cylindrical or circular role made of material having a high hardness, such as highly hard ceramics is used. Also, a role composed of a ferrous core and diamond grains bonded on the peripheral surface of the core can be used. The electroplated grinding wheel is rotated in one direction so that the surface speed of the grinding wheel reaches a predetermined value while the role is rotated in the other direction so that the surface speed of the grinding wheel reaches a value substantially equal to the predetermined value, whereby the surface speed difference between the grinding wheel and the role becomes almost zero. Under this condition, the role is relatively moved radially toward the peripheral surface of the grinding wheel until the role crushes the abrasive grains of the grinding wheel.

Since the role is made of very hard material, the abrasive grains are finely crushed, thereby reducing the grinding resistance. Since the role is rotated to make the surface speed difference between the grinding wheel and the role be zero, the role gives to the abrasive grains only force in the radial direction of the grinding wheel without giving force in the rotational direction. As a result, it is possible to prevent to abrasive grains from dropping from the core, thereby increasing the service life of the grinding wheel. Since both of the grinding wheel and the role are rotated compulsorily, it is possible to reduce a shock which would otherwise occur when the role engages with the grinding wheel, thereby preventing part of the abrasive grains are excessively crushed. This ensures that all of the abrasive grains held by the core are crushed uniformly.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiment when considered in connection with the accompanying drawings, in which.

DETAILED DESCRIPTION OF PREFERRED EMBODIMENT

Figure 1:
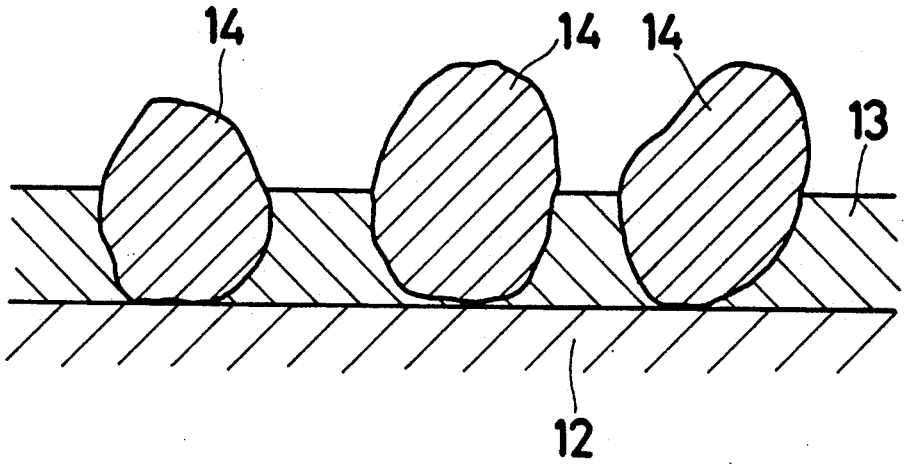
FIG. 1 is a partial view of an electroplated grinding wheel before dressing or truing.
Figure 2:
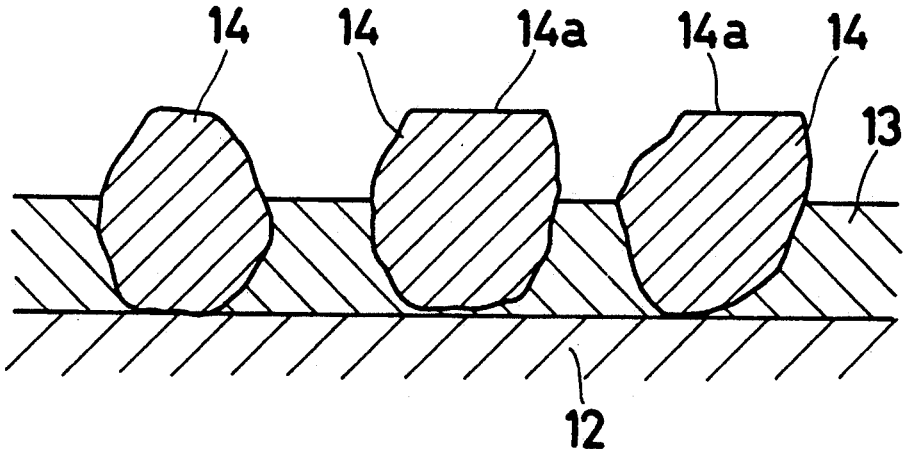
FIG. 2 is a partial view of an electroplated grinding wheel after truing.
Figures 3, 4:
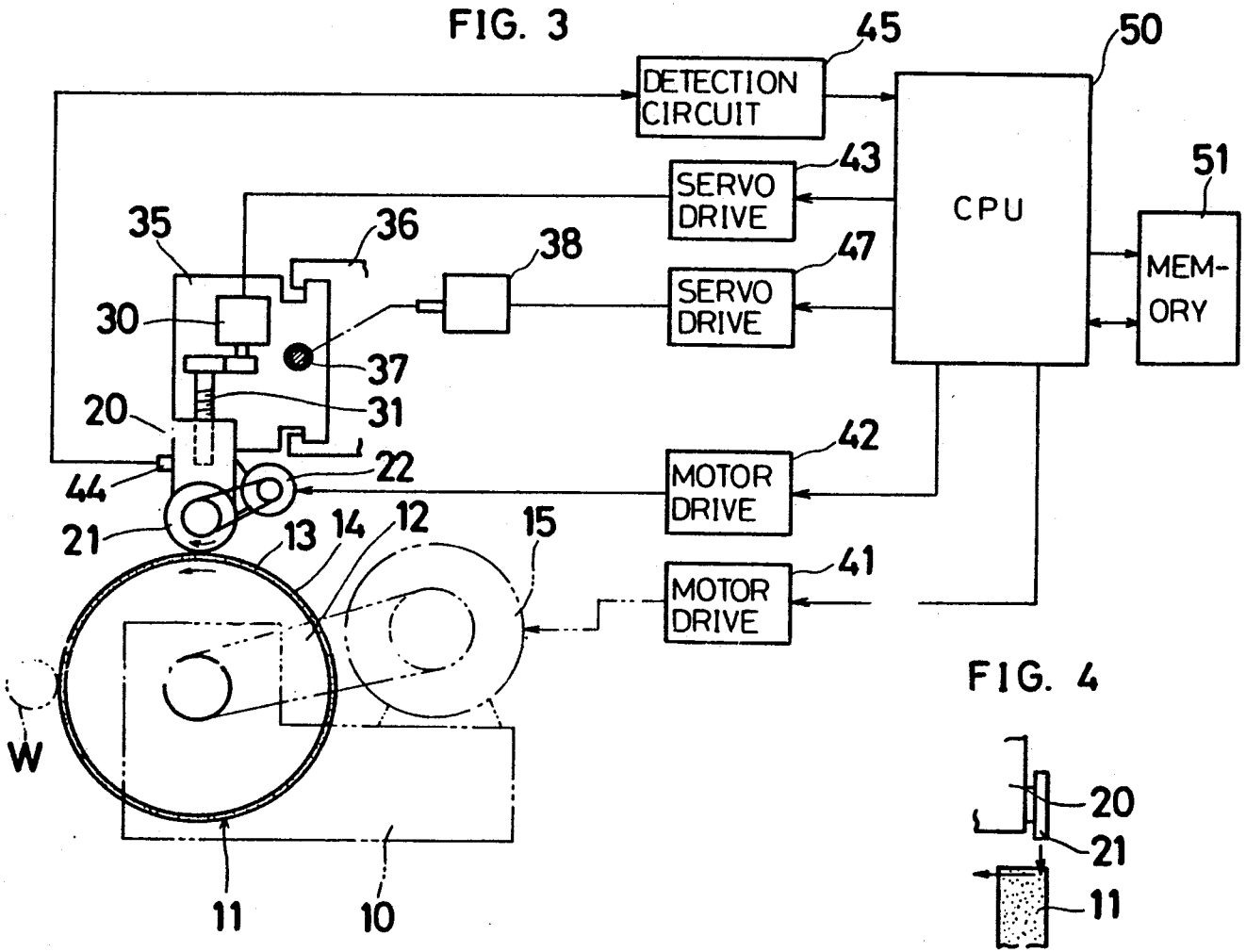
FIG. 3 is a schematic side view of a dressing apparatus according to an embodiment of the present invention.
FIG. 4 is a partial front view of the dressing apparatus.

A preferred embodiment of the present invention will now be described with reference to figures. In FIG. 3, numeral 10 denotes a wheel head on which an electroplated grinding wheel 11 is supported to be rotatable. The grinding wheel 11 is rotated by a motor 15 mounted on the wheel head 10 via pulleys and a belt. The grinding wheel 11 is composed of a circular core 12 made of ferrous material, a nickel plating layer 13, and abrasive grains 14 such as diamond grains and CBN (Cubic Boron Nitride) grains, which are held on the peripheral surface of the core 12 by the nickel plating layer 13. Numeral 20 denotes a dresser head on which a circular or cylindrical role 21 is supported to be rotatable about an axis parallel to the rotational axis of the grinding wheel 11. The role 21 is rotated by a motor 22 mounted on the dresser head 20 via pulleys and a belt. The role 21 is a circular plate made of a ceramics having a high hardness, such as silicon carbide (SiC). Also, a role composed of a ferrous core and diamond grains bonded on the peripheral surface of the core, and other types of hard roles can be used. The width of the role 21 is narrower than that of the grinding wheel 11, as shown in FIG. 4. The dresser head 20 is guided on a traverse slide 35 to be radially movable with respect to the grinding wheel 11. The dresser head 20 is moved by a screw feed mechanism 31 driven by a servomotor 30 mounted on the traverse slide 35. The traverse slide 35 is guided on a base 36 for horizontal movement parallel to the rotational axis of the grinding wheel 11. The traverse slide 35 is moved by the rotation of a feed screw 37 rotated by a servomotor 38.

The motor 15 is controlled by a first motor drive circuit 41 so that the grinding wheel 11 is rotated at a predetermined surface speed in the counterclockwise direction as shown in FIG. 3. Also, the motor 22 is controlled by a second motor drive circuit 42 so that the role 21 is rotated at a surface speed which is substantially the same as that of the grinding wheel 11 in the clockwise direction as shown in FIG. 3. As a result, the difference in surface speed between the grinding wheel 11 and the role 21 is substantially zero.

The servomotors 30 and 38 are connected to a numerical controller 50 through servo drive circuits 43 and 47 to be controlled thereby. The dressing apparatus is also provided with an AE (Acoustic Emission) sensor 44 to detect whether or not the role 21 contacts with the grinding wheel 11. The sensor 44 is connected to the numerical controller 50 through a detection circuit 45. The first and second motor drive circuits 41 and 42 are also connected to the numerical controller 50.

Figure 5:
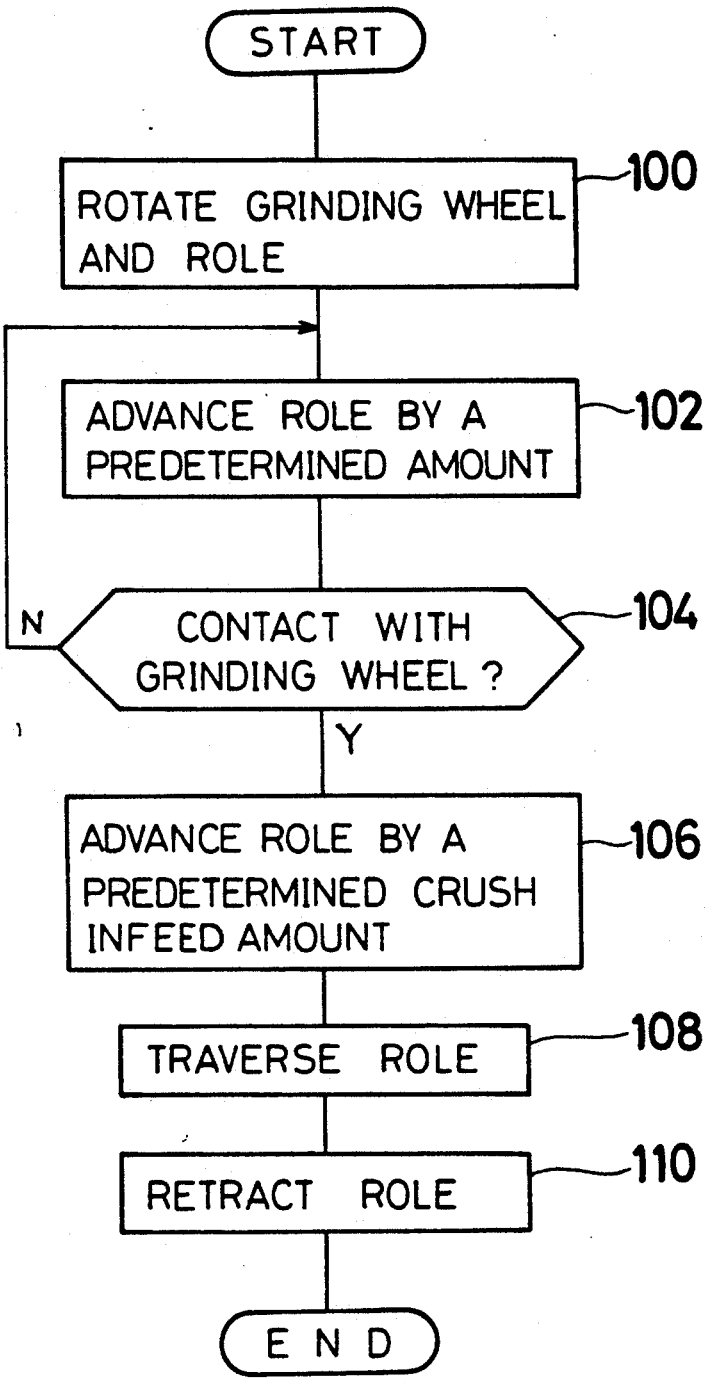
FIG. 5 is a flow chart showing the processing of a CPU shown in FIG. 3.

The operation of the numerical controller 50 will be described hereinafter with reference to a flowchart shown in FIG. 5.

At first step 100, the numerical controller 50 commands the motor drive circuits 41 and 42 to rotate the motor 15 and 22, respectively. As a result, the grinding wheel 11 is rotated at a predetermined surface speed in the counterclockwise direction while the role 21 is rotated in the clockwise direction at a surface speed substantially the same as that of the grinding wheel 11.

At next step 102, command pulses of predetermined number are generated by the numerical controller 50 and output to the servo drive circuit 43. As a result, the servomotor 30 rotates so that the dresser head 20 is advanced toward the grinding wheel 11 by a predetermined small amount. After that, it is judged at step 104 whether or not the role 21 has contacted with the peripheral surface of the grinding wheel 11. When it is judged that the role 21 has not contacted with the grinding wheel 11 yet, the processing moves from step 104 back to 102 to continue the advance movement of the role 21. When it is judged that the role 21 has contacted with the grinding wheel 11, the processing moves from step 104 to step 106.

At step 106, an infeed of a predetermined crush infeed amount is carried out by the pulse distribution to the driving circuit 43. After this infeed movement, the traverse slide 35 is moved by the servomotor 38 at step 108 so that the role 21 passes along the peripheral surface of the grinding wheel 11 in a direction parallel to the rotational axis of the grinding wheel 11. After this operation, the role 21 is retracted to its original position at step 110.

Figure 6:
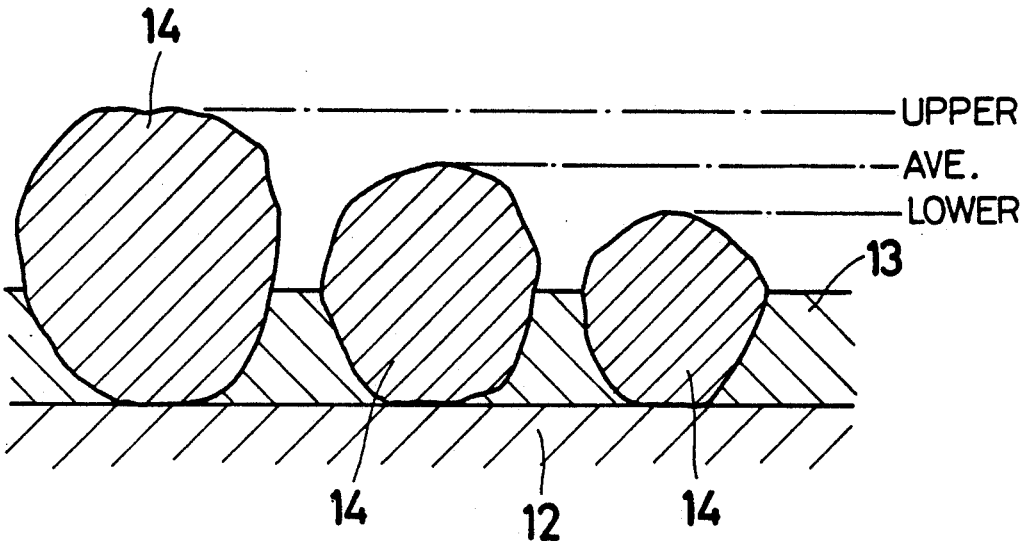
FIG. 6 is a chart showing the upper grain size and lower grain size of abrasive grains.
Figure 7:
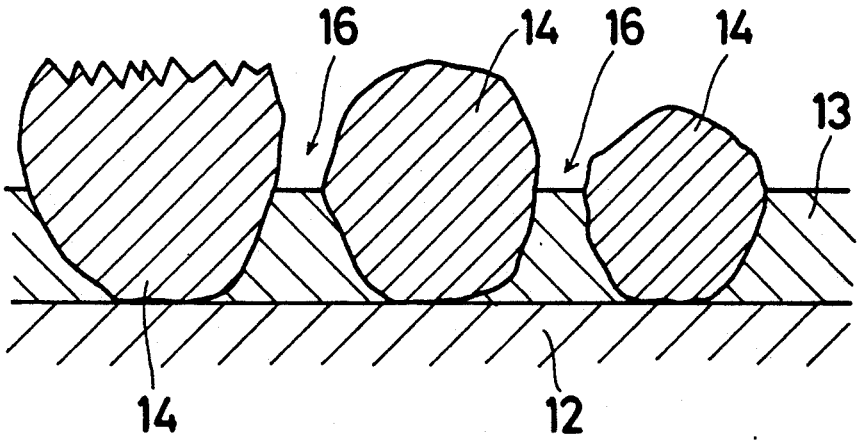
FIGS. 7 and 8 are partial views of an electroplated grinding wheel after being dressed.

The infeed amount is adjusted depending on the size difference between the upper grain size and lower grain size of the abrasive grains 14. FIG. 6 shows a relation ship between the upper grain size, lower grain size and average grain size of the abrasive grain 14. The upper grains size and lower grain size correspond to mesh sizes of a pair of sieves which are used to select abrasive grains. In cases where the infeed amount is substantially equal to the half of the size difference between the upper and lower grain sizes, only abrasive grains having heights higher than that of the average grain size are crushed, as shown in FIG. 7. In this case, relatively large chip pockets 16 are formed at the periphery of the grinding wheel 11, while many sharp cutting edges are also formed on the abrasive grains. These chip pockets and sharp edges decrease the grinding resistance during grinding operations.

Figure 8:
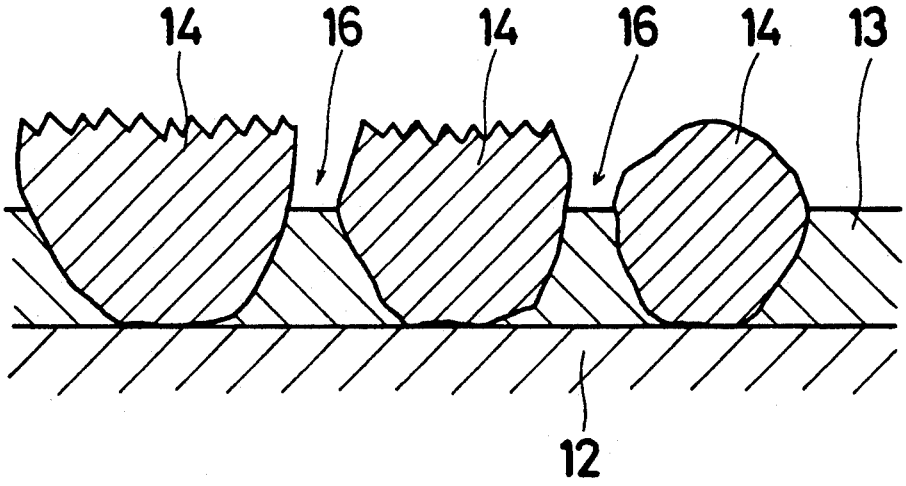

In cases where the infeed amount is substantially equal to the size difference between the upper and lower grain sizes, abrasive grains having heights higher than that of the lower grain size are crushed, as shown in FIG. 8. In this case, although the depths of the tip pockets 16 are small, a large number of sharp cutting edges are formed at the periphery of the grinding wheel 11, as compared with the aforementioned case. The chip pockets 16, however, have depths deeper than a required depth.

In cases where the infeed amount is an amount between the size difference and the half of the size difference, many sharp cutting edges and chip pockets of sufficient depth are formed, to thereby decrease the grinding resistance during grinding operations.

As is understood from the above description, the preferred infeed amount is in a range between the size difference and the half of the size difference. Although a preferred infeed amount changes depending upon the actual sizes of the abrasive grains, the infeed amount is in a range of a few microns to a few ten microns.

Since the role 21 is made of very hard material, the abrasive grains 14 are finely crushed, thereby reducing the grinding resistance. Since the role 21 is rotated to make the surface speed difference between the grinding wheel 11 and the role 21 is zero, the role 21 gives to the abrasive grains 14 only force in the radial direction of the grinding wheel 11 without giving force in the rotational direction. As a result, it is possible to prevent the abrasive grains 14 from dropping from the nickel plating layer 13, thereby increasing the service life of the grinding wheel 11. Since both of the grinding wheel 11 and the role 21 are rotated compulsorily so that the relative surface speed between the grinding wheel 11 and the role 21 is zero before the role 21 contacts with the grinding wheel 11, it is possible to reduce a shock which would occur when the role 21 engages with the grinding wheel 11, thereby preventing part of the abrasive grains 14 are excessively crushed. This ensures that all of the abrasive grains 14 held by the core 12 are crushed uniformly.

EXAMPLE 1

Figure 9:
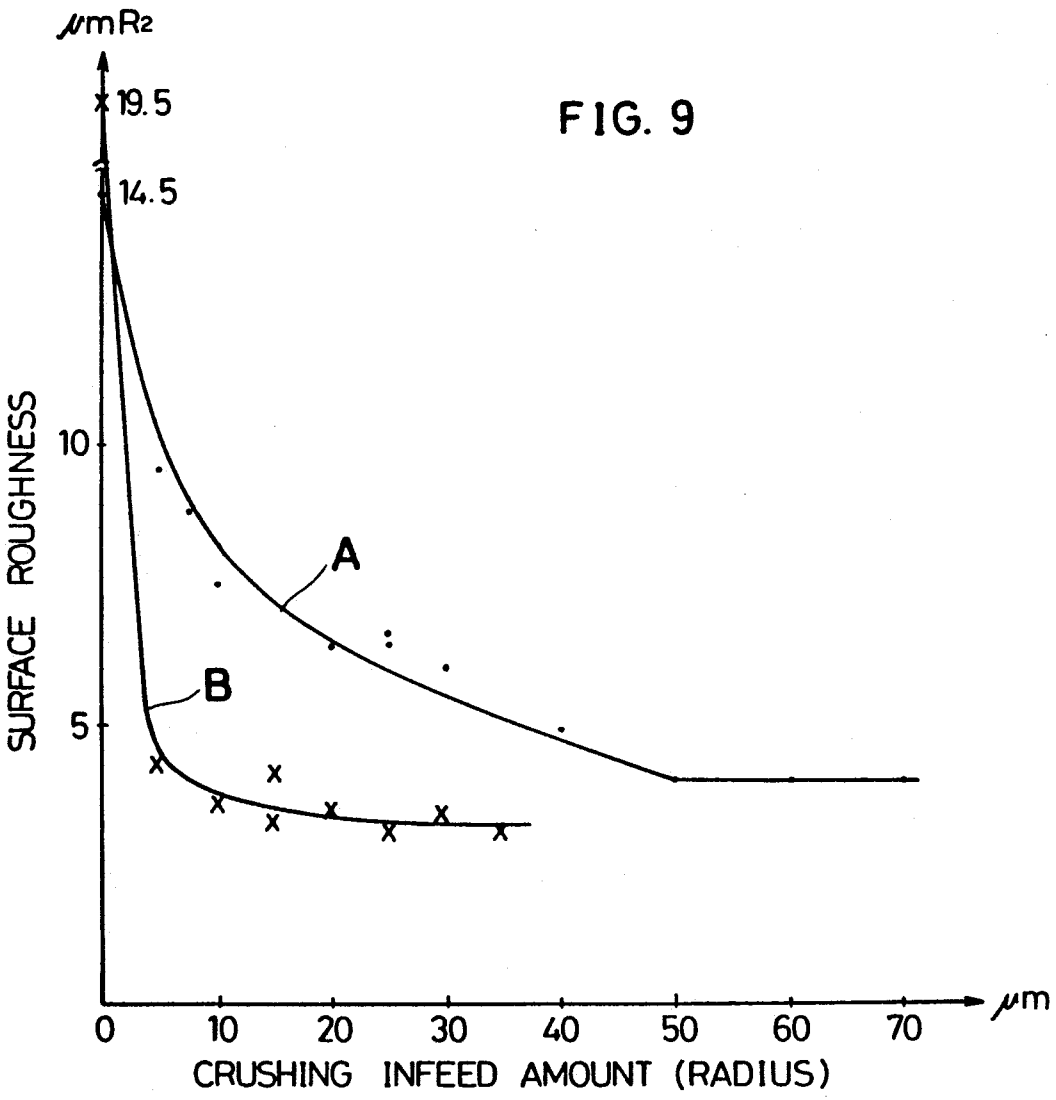
FIG. 9 is a chart showing relationships between the infeed amount of a role and the surface roughness of the finished surface of a test piece in cases where small abrasive grains and large abrasive grains are used, respectively.

Diamond grains are used which are selected with a first sieve having No. 120 mesh and a second sieve having No. 140 mesh. Namely, diamond grains are first passed through the first sieve, and then passed though the second sieve. Diamond grains which have passed through the first sieve but not passed through the second sieve have diameters ranging from above 107 microns to about 125 microns, and the average grain size is 116 microns. The selected diamond grains are used for making an electroplated grinding wheel. The grinding wheel is dressed by the infeed movement of a role made of silicon carbide, and a test piece made of carbon is then ground with the grinding wheel. After that, the surface roughness of the finished surface of the test piece is measured. The dressing operation and grinding operation are repeated for difference crush infeed movements. The test results are shown by the curve A in FIG. 9. As is understood from the curve A, when the infeed amount of 10 microns, which is roughly equal to the half of the size difference between the upper grain size and lower grain size, is carried out, the surface roughness becomes about half as compare with that obtained in the event that a grinding wheel is used without any dressing. Therefore, in this case any infeed movement larger than 10 microns is preferable. However, when the infeed amount becomes too large, in service life of the grinding wheel becomes short. Accordingly, the preferred infeed amount is in a range of about 10 to about 20 microns.

EXAMPLE 2

Diamond grains are used which are selected with a first sieve having No. 270 mesh and a second sieve having No. 325 mesh. Namely, diamond grains are first passed through the first sieve, and then passed though the second sieve. Diamond grains which have passed through the first sieve but not passed through the second sieve have diameters ranging from above 48 microns to about 56 microns, and the average grain size is 51 microns. The selected diamond grains are used for making an electroplated grinding wheel. The grinding wheel is dressed by the infeed movement of a role made of silicon carbide, and a test piece made of carbon is then ground with the grinding wheel. After that, the surface roughness of the finished surface of the test piece is measured. The dressing is repeated for difference crush infeed movements. The test results are shown by the curve B in FIG. 9. As is understood from the curve B, when the infeed amount of 5 microns, which is roughly equal to the half of the size difference between the upper grain size and lower grain size, is carried out, the surface roughness becomes about one force as compare with that obtained in the event that a grinding wheel is used without any dressing. Therefore, in this case, any infeed movement larger than 5 microns is preferable. However, when the infeed amount becomes too large, the service life of the grinding wheel becomes short. Accordingly, the preferred infeed amount is in a range of about 5 to about 10 microns.

Although the traverse slide is provided in the above mentioned example for the traverse movement of the role, the traverse slide can be omitted in cased where the width of the role is larger than that of the grinding wheel.

Obviously, numerous modifications and variations of the present invention are possible in light of the above teachings. It is therefore to be understood that within the scope of the appended claims, the present invention may be practiced otherwise than as specifically described herein.

What is claimed is:

1. A method of dressing an electroplated grinding wheel having a circular core and a single layer of hard abrasive grains held on the peripheral surface of said core by a plating layer, said method comprising steps of:

rotating said grinding wheel about a first axis in a direction;

rotating a circular role made of ceramics about a second axis at a predetermined speed in a direction opposite to the rotational direction of said grinding wheel so that the difference in surface speed between said role and said grinding wheel becomes substantially zero at a location at which said role contact with said grinding wheel, said first axis and second axis being in a common plane; and effecting relative infeed movement between said role and said grinding wheel in a radial direction of said grinding wheel so that said role is relatively fed toward the peripheral surface of said grinding wheel by a predetermined infeed amount from a radial position corresponding to the radial position of the peripheral surface of said grinding wheel, said infeed amount being larger than half of the size difference in diameter between the upper grain size and the lower grain size of the abrasive grains.

2. A method for dressing an electroplated grinding wheel according to claim 1, wherein the infeed amount is in a range of a first amount corresponding to the half of the size difference in diameter between the upper grain size and lower grain size of said abrasive grains, and a second amount corresponding to the size difference.

3. A method of dressing an electroplated grinding wheel having a circular core and a single layer of hard abrasive grains held on the peripheral surface of said core by a plating layer, said method comprising steps of:

rotating said grinding wheel about a first axis in a direction;

rotating a circular role made of hard material about a second axis at a predetermined speed in a direction opposite to the rotational direction of said grinding wheel so that the difference in surface speed between said role and said grinding wheel becomes zero at a location at which said role contact with said grinding wheel, said first axis and second axis being in a common plane; and effecting relative infeed movement between said role and said grinding wheel in a radial direction of said grinding wheel so that said role is relatively fed toward the peripheral surface of said grinding wheel by a predetermined infeed amount from a radial position corresponding to the radial position of the peripheral surface of said grinding wheel.

4. A method of dressing an electroplated grinding wheel having a circular core and a single layer of hard abrasive grains held on the peripheral surface of said core by a plating layer, said method comprising steps of:

rotating said grinding wheel about a first axis in a direction;

rotating a circular role made of hard material about a second axis at a predetermined speed in a direction opposite to the rotational direction of said grinding wheel so that the difference in surface speed between said role and said grinding wheel becomes substantially zero at a location at which said role contact with said grinding wheel, said first axis and second axis being in a common plane; and effecting relative infeed movement between said role and said grinding wheel in a radial direction of said grinding wheel so that said role is relatively fed toward the peripheral surface of said grinding wheel by a predetermined infeed amount from a radial position corresponding to the radial position of the peripheral surface of said grinding wheel, said infeed amount being larger than half of the size difference in diameter between the upper grain size and the lower grain size of the abrasive grains.

5. A method for dressing an electroplated grinding wheel according to claim 4, wherein the infeed amount is in a range of a first amount corresponding to the half of the size difference in diameter between the upper grain size and lower grain size of said abrasive grains, and a second amount corresponding to the size difference.

* * * * *